US008114229B1

(12) United States Patent
Petersen et al.

(10) Patent No.: US 8,114,229 B1
(45) Date of Patent: Feb. 14, 2012

(54) SELF-EXTINGUISHABLE SOLID PROPELLANT

(75) Inventors: Eric L. Petersen, College Station, TX (US); Sudipta Seal, Orlando, FL (US); Matthew Stephens, Elkton, MD (US); David L. Reid, Orlando, FL (US); Rodolphe Carro, Melbourne, FL (US); Thomas Sammet, Orlando, FL (US); Alex Lepage, Oviedo, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 302 days.

(21) Appl. No.: 12/413,269

(22) Filed: Mar. 27, 2009

Related U.S. Application Data

(60) Provisional application No. 61/040,044, filed on Mar. 27, 2008.

(51) Int. Cl.

| | |
|---|---|
| ***C06B 45/00*** | (2006.01) |
| ***C06B 45/18*** | (2006.01) |
| ***C06B 29/00*** | (2006.01) |
| ***C06B 29/02*** | (2006.01) |
| ***D03D 23/00*** | (2006.01) |
| ***D03D 43/00*** | (2006.01) |

(52) U.S. Cl. ..... 149/2; 149/3; 149/75; 149/76; 149/109.4

(58) Field of Classification Search ..... 149/2, 3, 149/75, 76, 109.4

See application file for complete search history.

(56) References Cited

U.S. PATENT DOCUMENTS

| | | | | |
|---|---|---|---|---|
| 3,000,317 | A * | 9/1961 | Kirchner | 102/290 |
| 3,897,514 | A * | 7/1975 | Allabashi | 528/92 |
| 4,221,617 | A * | 9/1980 | Rudy et al. | 149/19.5 |
| 6,313,334 | B1 * | 11/2001 | Hebekeuser et al. | 556/145 |
| 6,896,751 | B2 * | 5/2005 | Posson et al. | 149/19.92 |

OTHER PUBLICATIONS

Bimal P. Singh, et al., "Evaluation of Dispersibility of Aqueous Alumine Suspension in Presence of Darvan C", Ceramics International 30 (2004) 939-946, Elsevier Ltd. and Techno Group.

A. Schrijnemakers, et al., "Mullite Coatings on Ceramic Substrates: Stabilisation of Al2O3—SiO2 Suspensions for Spray Drying of Composite Granules Suitable for Reactive Plasma Sparying", Journal of the European Ceramic Society 29 (2009) 2169-2175, Elsevier Ltd.

* cited by examiner

*Primary Examiner* — James McDonough

(74) *Attorney, Agent, or Firm* — Jetter & Associates, P.A.

(57) ABSTRACT

Solid composite propellant compositions include at least one oxidizing agent, at least one binder, and at least one surfactant. The surfactant provides the solid propellant the property of being "self-extinguishing", where the burning rate of the solid composite propellant as a function of pressure includes a negative pressure dependence portion, wherein the burning rate in the negative pressure dependence portion decreases with increasing pressure until a cutoff pressure is reached which results in extinguishment of the solid composite propellant. The solid composite propellant can also include at least one catalyst that modifies the burning rate of the solid composite propellant. Solid composite propellants can be extinguished without the need for depressurization by reaching a cutoff pressure, and with a tailored burning rate.

16 Claims, 5 Drawing Sheets

SELF-EXTINGUISHABLE SOLID PROPELLANT

CROSS REFERENCE TO RELATED APPLICATIONS

This application claims the benefit of Provisional Application Ser. No. 61/040,044 entitled "EXTINGUISHABLE PROPELLANT COMPOSITES FOR APPLICATIONS INCLUDING DIVERT AND ATTITUDE CONTROL SYSTEM (DACS) PROPULSION" filed Mar. 27, 2008, which is hereby incorporated by reference in its entirety.

FEDERAL RIGHTS STATEMENT

The U.S. Government has rights to embodiments of the invention based on Missile Defense Agency contract # HQ0006-05-0023.

BACKGROUND

A solid rocket motor or composite propellant rocket motor is a rocket with a motor that uses solid propellants comprising a fuel and an oxidizer. The solid propellant is normally in the form of a propellant grain placed within the interior of the rocket motor (e.g. in the combustion chamber) and burned to produce hot gases which, in turn, exit through the throat and nozzle of the rocket motor at high velocity to provide thrust which propels the rocket in the opposite direction.

Although liquid rockets are commonly used today due to better efficiency and controllability as compared to solid rockets, solid rockets are still used in certain applications primarily because they are relatively easy to manufacture and generally exhibit excellent performance characteristics. In addition, solid rockets are generally less complex as compared to those employing liquid fuels. However, unlike liquid propellant rockets, solid propellant rockets are unable to control or alter their thrust characteristics after ignition by adjusting the amount of fuel entering the area of combustion.

Known composite propellant rocket motors have generally been shut-off by a process of sudden depressurization, but the Present Inventors are not aware of a disclosed shut-off process functional at operational pressures. Some shut-off processes involve a destructive means of operation, such as requiring physical rupture of the case in some fashion to depressurize the combustion chamber. This practice has several pitfalls, such as severe structural damage to the motor and uncontrolled burn-off of the remaining solid propellant.

In one application for solid rockets, the interception of attacking ballistic missiles above the atmosphere is achieved by launching an interceptor missile against the attacking missile. The interceptor is directed toward the attacking missile (the so called "target") and preferably hits it or explodes in the vicinity of the target, generally causing the target severe damage and perhaps even complete destruction. Typically, the interceptor comprises a one (or several) stage booster and the so-called "kill vehicle".

Generally, the kill vehicle is required to maneuver in space in order to adjust its position with regard to its target, to compensate for cuing errors raised by ground or space detection and tracking systems and onboard navigation errors and in response to tracked target maneuvers. Future missile defense systems will generally employ kinetic-energy kill vehicles. The two primary components of a kinetic-energy kill vehicle include sensors for target identification and tracking, and a divert and attitude control system (DACS) for maneuvering the kill vehicle. One of the promising technologies for the interceptor's DACS propulsion is the use of a solid rocket motor. A solid DACS is preferable over a liquid-based system for reasons described above.

To satisfy the extreme requirements of a DACS motor, which can include trajectory adjustment and multiple firings, the solid rocket motor must be able to be extinguished and relit, generally a plurality of times. To date, the extinguishment of burning solid propellants does not occur naturally, so the available technology generally requires a complicated rapid depressurization technique to stop the propellant's burning.

SUMMARY

This Summary is provided to comply with 37 C.F.R. §1.73, presenting a summary of the invention to briefly indicate the nature and substance of the invention. It is submitted with the understanding that it will not be used to interpret or limit the scope or meaning of the claims.

Embodiments of the present invention describe solid composite propellant compositions, also referred to as a propellant grain, comprising at least one oxidizing agent, at least one binder, and at least one surfactant. The addition of a suitable surfactant has been found by the Present Inventors to provide the solid propellant the unexpected property of being "self-extinguishing". "Self-extinguishing" as defined herein refers to the burning rate as a function of pressure including a negative pressure dependence portion, wherein the burning rate in the negative pressure dependence portion decreases with increasing pressure until a cutoff pressure is reached which results in extinguishment of the solid composite propellant. The solid composite propellant can also comprise at least one catalyst that modifies the burning rate of the solid composite propellant. Significantly, solid composite propellants according to embodiments of the invention thus can be extinguished without the need for depressurization by reaching a cutoff pressure, and with a tailored burning rate.

The discovery of an additive that allows a composite propellant to become self-extinguishable is highly unexpected because the natural extinguishment of a solid propellant has been considered difficult if not impossible, and also because of its simplicity. Surfactant materials are conventionally utilized to prevent the agglomeration of nanoparticles, but have been unknown prior to discover by the Present Inventors for solid composite propellant compositions.

Solid composite propellants according to embodiments of the invention are thus self-extinguishing, which allows rocket-based systems to be less complicated. For example, for use in DACS applications, such as for kill-vehicles. Self-extinguishing solid composite propellants according to embodiments of the invention can have its burning rate, thrust profile, and weight tailored to meet a specific missile application.

As used herein, the term "surfactant" refers to a material having both a lipophilic component and a hydrophilic component, and includes surface active polymers. As known in the art, surfactants are generally classified by the presence of formally charged groups in its head, with non-ionic, cationic, anionic, and cationic surfactants. If a surfactant contains a head with two oppositely charged groups, it is termed zwitterionic. All surfactant types can generally be used with embodiments of the invention.

In one embodiment, the propellant grain can comprises a progressive burning grain that increases its burning rate as it burns. In one embodiment, the progressive grain comprises a tubular grain geometry which as burn time goes increases, increases in burning surface area. This burning behavior applied in a solid rocket motor can cause the pressure and thrust of the motor to increase over time until the cutoff pressure is reached and extinguishment results.

DETAILED DESCRIPTION

Figure 1:
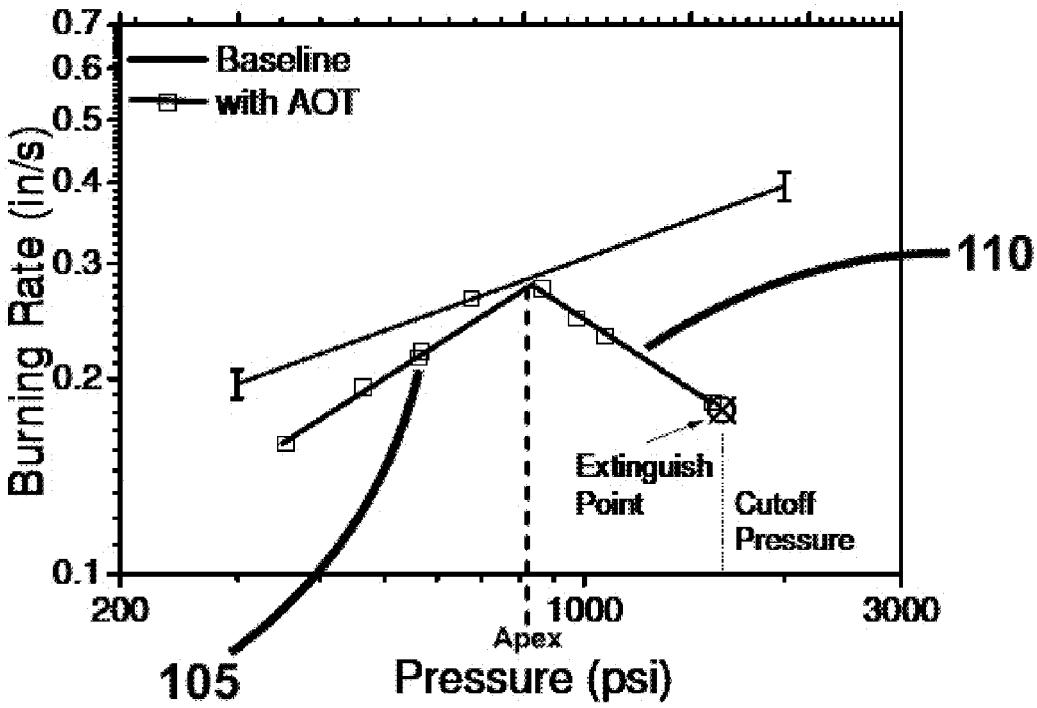
FIG. 1 shows the burning rate data for a conventional "baseline' 80/20 ammonium perchlorate (AP)/hydroxyl-terminated polybutadiene (HTPB) solid propellant as compared to a self-extinguishing composite propellant according to an embodiment of the invention comprising an identical AP/HTPB propellant composition with the exception of the addition of an exemplary anionic surfactant comprising sodium dioctyl sulfosuccinate ($C_{20}H_{37}O_7S$)Na (AOT).

The present invention is described with reference to the attached figures, wherein like reference numerals are used throughout the figures to designate similar or equivalent elements. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

Embodiments of the invention describe new self-extinguishing composite propellant compositions. As described above, a self-extinguishing composite propellant refers to a propellant that provides a burning rate as a function of pressure that includes a negative pressure dependence portion, wherein the burning rate in the negative pressure dependence portion decreases with increasing pressure until a cutoff pressure is reached which results in extinguishment of the solid composite propellant. The burning rate also generally includes a positive pressure dependence portion having an increasing burning rate with increasing pressure until a maximum burning rate is reached at an apex pressure, wherein the negative pressure dependence portion beginning after the apex pressure is reached.

FIG. 1 shows burning rate data for a conventional 80 mass %/20 mass % AP/HTPB solid propellant as compared to a self-extinguishing composite propellant according to an embodiment of the invention comprising an identical AP/HTPB propellant composition with the exception of the addition of an exemplary anionic surfactant comprising sodium dioctyl sulfosuccinate, ($C_{20}H_{37}O_7S$)Na (AOT) that has been found to unexpectedly provide self-extinguishing properties. The AOT comprised 6.66% mass of the self-extinguishing composite propellant according to an embodiment of the invention.

The conventional AP/HTPB solid propellant is seen to increase in burning rate as the pressure increases in a generally linear fashion. In contrast, the AP/HTPB propellant composition including AOT according to an embodiment of the invention includes a positive pressure dependence portion 105 having an increasing burning rate with increasing pressure until a maximum burning rate is reached at an apex pressure, and a negative pressure dependence portion 110 wherein the burning rate in negative pressure dependence portion decreases with increasing pressure until a cutoff pressure is reached which results in extinguishment of the solid composite propellant beginning after the apex pressure is reached. Such a burning profile can be referred to as an "apex" burning rate profile. The Present Inventors have observed that the AP/HTPB propellant composition including AOT according to an embodiment of the invention would not burn for pressures above a maximum value (for pressures greater than the last data point near 1300 psi in FIG. 1 shown as the "cutoff pressure").

The Present Inventors have observed that if the pressure first begins at a value below the cutoff pressure at the start of the burn and then increases during the burn to a level at or above this cut-off value, the propellant self-extinguishes. This phenomenon has been found to be very repeatable, and it has also been found that the cutoff pressure as well as the slope of the negative pressure dependence is a function of the amount of surfactant and/or catalyst as described below is present in the propellant mixture.

The propellant composition can further include a fuel that can comprise a variety of fuels, such as Al. The fuel can be in the form of a nanopowder, such as an Al nanopowder. The average size of the nanopowder particles can be in the 100 s of nms, 10 s of nms, or several nms (e.g. 5 to 10 nm).

The oxidizing agent can comprise a variety of oxidizing agents. In certain embodiments, the oxidizing agent comprises AP or ammonium nitrate (AN).

The binder can comprise a variety of binders. Many of the known binder materials are polymeric materials. In one embodiment the binder comprises HTPB.

In some embodiments of the invention, the solid composite propellant can also comprise at least one catalyst that modifies the burning rate of the solid composite propellant. The catalyst can be a nanoparticle catalyst. In one embodiment of the invention the nanoparticle catalyst comprises nanocrystalline titania doped with at least one metal, wherein the metal is about 1 to 10 at. % of nanoparticle catalyst. The titania is generally primarily anatase such as at least 60%, 70% or 80%.

In one embodiment of the invention, both the fuel and catalyst for the propellant grain are provided by fuel/catalyst core-shell composite nanoparticles. For example, in one embodiment, the fuel/catalyst core-shell composite nanoparticles can comprise aluminum/titania core-shell composite nanoparticles.

The surfactant generally comprises 1 to 20 wt % of the solid composite propellant. As described above, the surfactant can generally be a non-ionic, ionic anionic, cationic, or zwitterionic surfactant. In one embodiment of the invention, the surfactant comprises an anionic surfactant, such as AOT.

Figure 2:
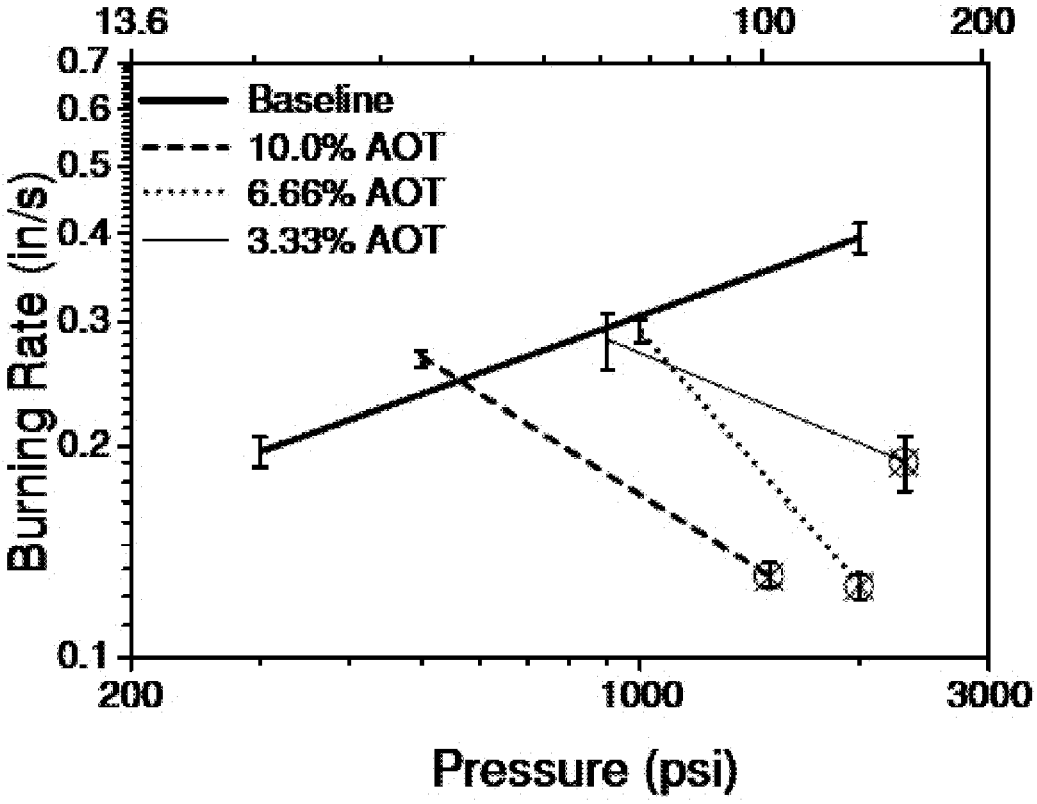
FIG. 2 shows comparative burning rate data for a conventional 80/20 AP/HTPB solid propellant as compared to an otherwise identical AP/HTPB propellant composition with added AOT in various levels according to embodiments of the invention, in a pressure range for the negative pressure dependence portion (reference 110 in FIG. 1) for the AP/HTPB/AOT composite propellant.

FIG. 2 shows comparative burning rate data for a conventional 80/20 AP/HTPB solid propellant as compared to an otherwise identical AP/HTPB propellant composition with added AOT in various levels, according to an embodiment of the invention, in a pressure range for the negative pressure dependence portion (reference 110 in FIG. 1) for the AP/HTPB/AOT composite propellant. The AOT levels shown are for 3.33, 6.66 and 10.0 mass %. The AP/HTPB/AOT composite propellant is seen to evidence the ability to change the cutoff pressure and the pressure dependency (e.g. slope) by changing the level of surfactant.

Figure 3:
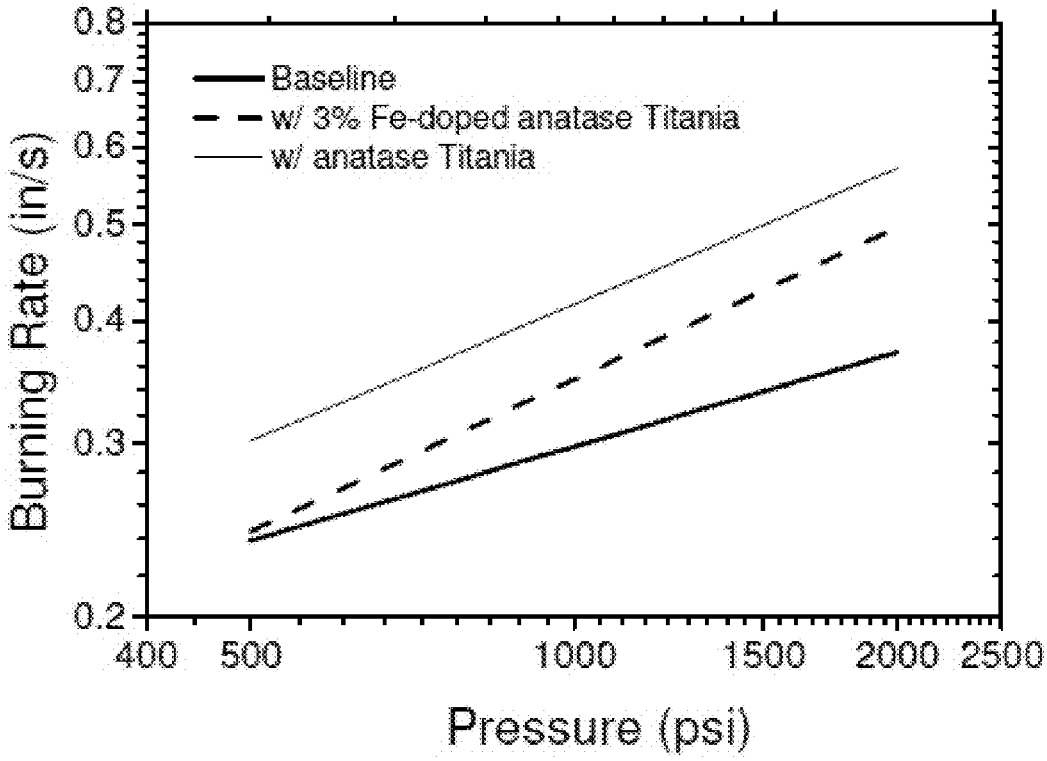
FIG. 3 shows burning rate data for two exemplary solid propellants according to embodiments of the invention with different nano-sized titania (catalyst) additives in comparison to a conventional 80/20 AP/HTPB baseline propellant without any catalyst additives.

As described above, the solid composite propellant can also comprise at least one catalyst that modifies the burning rate of the solid composite propellant. FIG. 3 shows burning rate data for two exemplary solid propellants according to embodiments of the invention with different nano-sized titania (catalyst) additives in comparison to a conventional 80/20 AP/HTPB baseline propellant without additives. The additives are both 0.5% of total propellant mass. The dashed curve is for a solid composite propellant comprising a catalyst comprising anatase titania doped with 3% Fe according to an embodiment of the invention, the dark solid line for a solid composite propellant comprising a catalyst comprising anatase titania according to an embodiment of the invention, and the light solid line burning rate data from a conventional 80/20 AP/HTPB baseline propellant composition.

Figure 4A:
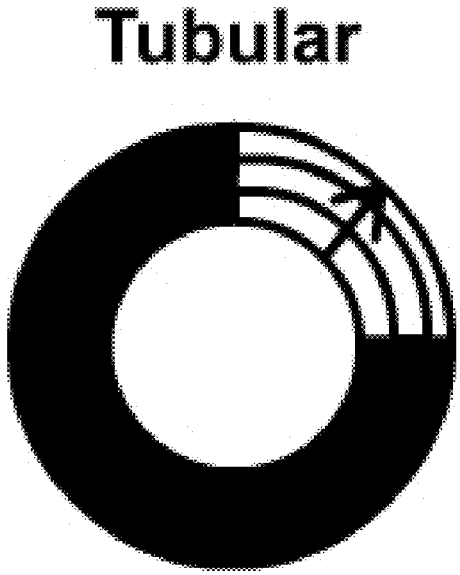
FIGS. 4A and B show depictions of a progressive burning grain and its burning characteristics, respectively, according to an embodiment of the invention.
Figure 4B:
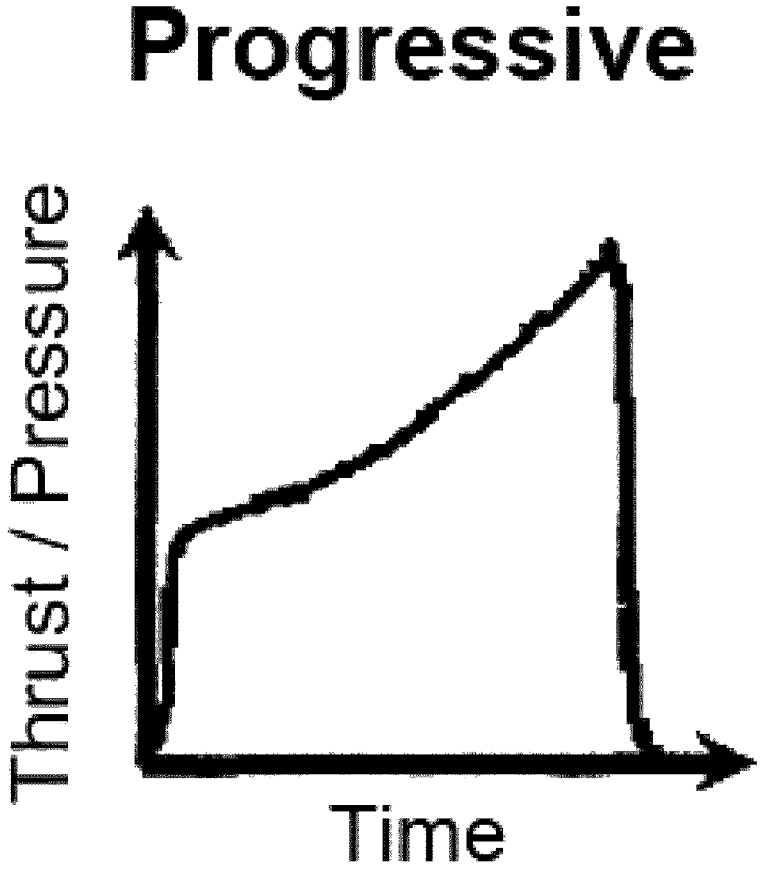

In one embodiment, the solid composite propellant composition can comprise a progressive burning grain that increases its burning rate as it burns. For example, the progressive burning grain comprises a tubular grain geometry which as the burn time increases, increases in burning surface area. In one application, the progressive burning propellant grain burns until the combustion chamber builds up enough pressure from normal operation to reach its upper burning limit, which extinguishes the propellant grain. FIGS. 4A and B show depictions of a progressive burning grain and its burning characteristics, respectively according to an embodiment of the invention.

Self-extinguishing propellant gains according to embodiments of the invention can be generally prepared in conventional fashion by adding the following sequentially to a mixing vessel:

1. Binder components (generally added as liquids);
2. Surfactant;
3. Plasticizers;
4. Optional burn rate catalyst(s)
5. Solid fuel(s) (incremental addition, e.g. Al);
6. Solid oxidizers (incremental addition); and
7. Cure catalyst(s) and curative(s) (e.g. isocyanate(s)).

The final mixing can be performed under vacuum, i.e., upon the addition of the solid fuel, which is typically a metal powder as described above having an average size in the nm range, such as 10 s of nms or hundreds of nm.

In one embodiment of the invention, a solid rocket motor can be static controlled using a progressive burning propellant grain according to an embodiment of the invention. This progressive burning behavior causes the pressure and thrust of the motor to increase over time. If an apex burning propellant is used in such geometry, the motor automatically shuts-off at such time when the internal pressure reaches the upper burning limit (cutoff pressure, such as shown in FIG. 1). Analysis and design alterations allow precise motor shut-off events without the violent consequences as seen in current practices. The self-extinguishable rocket motor can also be used to stop the burning in a motor that is experiencing large pressure fluctuations due to combustion instability. Combustion instability continues to be a problem in development and field rocket motors. The extinguishment of the propellant grain will avoid a rapid buildup of pressure that might cause catastrophic failure of the motor and the entire rocket and payload. The rocket motor could be re-lit to continue the mission, or at least the rocket and payload can be salvaged. These technique generally can be used with all motor applications and can generally also be easily created by modifying current (existing) motor systems (e.g. retrofit).

One application for self-extinguishing composite propellant compositions according to embodiments of the invention is for DACS solid motors. One attribute of solid motors is that they are less volatile as compared to liquid-based motors, which is a necessary requirement for shipboard applications. One of the impediments for making a solid DACS motor viable is the requirement that the solid propellant must be able to be extinguished and then relit, often multiple times. Because conventional solid rocket propellants are inherently incapable of this requirement, rapid depressurization is needed, such exposing the propellant to an expansion wave through rapid depressurization of the combustion chamber. Extinguishment through this known method requires a fast-acting expansion valve or similar device. Rapid depressurization requires externally calibrated hardware to vent the motor chamber. The self-extinguishment method disclosed herein is conceptually different from rapid depressurization in that the ability to extinguish is tied directly to the propellant composition. In contrast, self-extinguishing composite propellant compositions according to embodiments of the invention described above provide the propellant the unique characteristic that the propellant can self-extinguish for a particular range of pressures. In addition, as described above, the propellant formula also exhibits a burning rate with a negative pressure dependence, with the pressure at which the propellant extinguishes being a function of the amount of additive present, with no need for a fast-acting expansion valve or similar device.

EXAMPLES

Embodiments of the present invention are further illustrated by the following specific Examples, which should not be construed as limiting the scope or content of embodiments of the invention in any way.

Formation of Catalyst Particles

Amorphous titania nanoparticles were prepared by a room-temperature sol-gel method using acetylacetone as stabilizing agent, and subsequently calcined at 250, 400, and 800° C. to produce amorphous, anatase, and rutile powders, respectively. The powders were analyzed by X-ray diffraction (XRD) to confirm the crystal phase and estimate the particle size. Transmission electron microscopy (TEM) images of the anatase and rutile powders, revealed agglomerates with nanocrystallite sizes of 10-15 and 200 nm, respectively. Strands of solid propellant were prepared with 0.5 wt. % of each additive for burning-rate testing. Each additive was also mixed with pure ammonium perchlorate (AP) to study the catalytic effect on AP decomposition Some experiments involving catalyst comprising titania doped with various metals were also performed. An elevated-temperature (80° C.) sol-gel method was used to produce anatase nanocrystalline titania doped with either 0, 3 or 5 atomic % iron, aluminum, or gadolinium. XRD and TEM images confirmed the anatase crystal phase and particle diameters of 5 nm. Lattice parameters were calculated from the XRD data. Band gaps were calculated from UV-visible spectroscopy (UV-Vis).

Fuel Comprising Nano-Aluminum with Minimized Native Oxide

Due to the strongly exothermic Al to $Al_2O_3$ reaction, powdered aluminum (typically 5-60 μm) has long found use in energetic materials such as thermites, explosives, and propellants. The rate of reaction is proportional to the surface area available for oxidation, and thus there is significant interest in the use of aluminum nanopowders in energetic materials. Commercial ultrafine aluminum powders are produced by electroexplosion of aluminum wire, or by plasma synthesis methods. However, the commercially available powders are of 100-200-nm particle diameter, well above the nano regime at which dramatic increases in surface area and reactivity are expected. In fact, some studies on truly nano-sized Al powders found that they perform more poorly than expected. This can be explained by a native aluminum oxide layer that forms on the surface of metallic aluminum upon exposure to air, and in the case of nanosized Al powders, the aluminum oxide layer encompasses a large fraction of the overall particle mass, leaving little remaining reactive aluminum in Al nanopowders.

To overcome this problem, a new solution-based method was developed by the Present Inventors to synthesize Al nanoparticles, using alkylamine alane compounds as precursors to Al nanoparticles. This method allows production of very small (e.g. 5-10 nm average size) aluminum nanoparticles. This solution synthesis method, has the advantage of greater control of particle size and morphology, allows the use of a variety of passivating materials, and does not require any special equipment (only an oxygen-free reaction environment). TEM images and the SAED pattern have confirmed the formation of pure aluminum nanoparticles with generally negligible (e.g. <1 nm thick) native oxide.

Fuel/Catalyst Core/Shell Nanoparticles

An aluminum/titania core-shell composite nanoparticle, which would contain both the fuel and the burning-rate modifier in a single particle, maximizes efficiency and weight considerations. Regarding the Synthesis of Aluminum/Titania Core-shell Nanopowder, the aluminum/titania core-shell nanopowder was produced by first synthesizing pure aluminum nanoparticles as described above, then by coating the nanoparticles with a layer of $TiO_2$. A challenge to this method is to synthesize the $TiO_2$ layer without the use of water, which if present would tend to oxidize the aluminum nanoparticles. By using titanium tetrachloride hydrolyzed by an alcohol, and an amorphous titania or titanium hydroxide layer was formed over the aluminum particles.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the following claims.

We claim:

1. A solid composite propellant composition, comprising:
at least one oxidizing agent,
at least one binder, and
at least one surfactant in an effective amount of at least 3.33 wt % of said solid composite propellant so that said solid composite propellant exhibits a burning rate as a function of pressure that includes a negative pressure dependence portion, said burning rate in said negative pressure dependence portion decreasing with increasing pressure until a cutoff pressure is reached which results in extinguishment of said solid composite propellant.

2. The solid composite propellant of claim 1, wherein said burning rate includes a positive pressure dependence portion increasing said burning rate with an increase of said pressure until a maximum burning rate is reached at an apex pressure, said negative pressure dependence portion beginning at a pressure above said apex pressure.

3. The solid composite propellant of claim 1, wherein said surfactant comprises said at least 6.66 wt % to 20 wt % of said solid composite propellant.

4. The solid composite propellant of claim 3, wherein said surfactant comprises an anionic or cationic surfactant.

5. The solid composite propellant of claim 4, wherein said anionic surfactant comprises sodium dioctyl sulfosuccinate, $(C_{20}H_{37}O_7S)Na$ (AOT).

6. The solid composite propellant of claim 1, wherein said oxidizing agent comprises ammonium perchlorate (AP) or ammonium nitrate (AN).

7. The solid composite propellant of claim 1, wherein said binder comprises hydroxyl-terminated polybutadiene (HTPB).

8. The solid composite propellant of claim 1, further comprising at least one catalyst that modifies said burning rate of said solid composite propellant.

9. The solid composite propellant of claim 8, wherein said catalyst comprises a nanoparticle catalyst.

10. The solid composite propellant of claim 9, wherein said nanoparticle catalyst comprises nanocrystalline titania doped with at least one metal, said titania being primarily anatase and said metal being 1 to 10 at. % of said nanoparticle catalyst.

11. The solid composite propellant of claim 1, further comprising at least one catalyst that modifies said burning rate of said solid composite propellant, wherein a fuel and said catalyst are provided by a plurality of fuel/catalyst core-shell composite nanoparticles.

12. The solid composite propellant of claim 11, wherein said plurality of said fuel/catalyst core-shell composite nanoparticles comprise aluminum/titania core-shell composite nanoparticles.

13. The solid composite propellant of claim 12, wherein said fuel comprises a nanopowder.

14. The solid composite propellant of claim 13, wherein nanopowder comprises aluminum nanopowder.

15. The solid composite propellant of claim 1, wherein said solid composite propellant composition comprises a progressive burning grain that increases said burning rate as it burns.

16. The solid composite propellant of claim 15, wherein said progressive burning grain comprises a tubular grain geometry which as a burn time increases, increases in burning surface area.

* * * * *